US006462730B2

(12) United States Patent
Numata et al.

(10) Patent No.: US 6,462,730 B2
(45) **Date of Patent: *Oct. 8, 2002**

(54) VEHICLE MOUNTED INPUT UNIT

(75) Inventors: Hidetaka Numata; Mikio Onodera; Katsuya Mitsuzuka, all of Miyagi-ken (JP)

(73) Assignee: Alps Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/317,783

(22) Filed: May 24, 1999

(65) Prior Publication Data

US 2002/0105495 A1 Aug. 8, 2002

(30) Foreign Application Priority Data

May 25, 1998 (JP) ..... 10-143089

(51) Int. Cl.[7] ..... G09G 5/00
(52) U.S. Cl. ..... 345/156; 345/161; 345/163
(58) Field of Search ..... 345/156, 158, 345/163, 355, 157, 160, 161; 180/333, 65.1

(56) References Cited

U.S. PATENT DOCUMENTS 4,701,629 A 10/1987 Citroën
5,086,870 A * 2/1992 Bolduc ..... 180/333
5,327,163 A 7/1994 Hashimoto et al.
5,980,256 A * 11/1999 Carmein ..... 434/55
5,995,104 A * 11/1999 Kataoka et al. ..... 345/355
6,129,165 A * 10/2000 Schaffner et al. ..... 180/65.1

* cited by examiner

*Primary Examiner*—Richard Hjerpe
*Assistant Examiner*—Kimnhung Nguyen
(74) *Attorney, Agent, or Firm*—Brinks Hofer Gilson & Lione

(57) ABSTRACT

A vehicle mounted input unit excellent in versatility and functional performance, which allows a manual operation section to be used as a mouse for a navigation system or a personal computer. The vehicle mounted input unit is composed of a body of equipment, a panel installed on an operating side of the body of equipment, an X-Y table, an engaging pin, a guide plate, a solenoid, a stick controller and a manual operation section. The guide plate is fitted to the X-Y table to be movable up and down and driven up and down through the solenoid. When the guide plate is lifted, the engaging pin and a guide groove are engaged with each other SO that the vehicle mounted input unit can be used as an operating unit for electronic equipment mounted in the motor vehicle. On the other hand, when the guide plate is lowered, the engaging pin and the guide groove are released form their engagement, at which time the manual operation section can be used as a mouse.

33 Claims, 7 Drawing Sheets

FIG. 12
PRIOR ART

WHEN AIRCONDITIONER IS SELECTED THROUGH SWITCH DEVICE

| SELECTED POSITION OF GUIDE GROOVE | FUNCTION TO BE SELECTED |
|---|---|
| A | NEUTRAL |
| B | AIR BLOWOUT POSITION |
| C | AIR BLOWOUT DIRECTION |
| D | AIR QUANTITY CONTROL |
| E | AUTOMATIC AIRCONDITIONER |
| F | FRONT DEFROSTER |
| G | TEMPERATURE CONTROL |
| H | REAR DEFROSTER |
| I | AIR BLOWOUT DIRECTION |

FIG. 13
PRIOR ART

WHEN RADIO IS SELECTED THROUGH SWITCH DEVICE

| SELECTED POSITION OF GUIDE GROOVE | FUNCTION TO BE SELECTED |
|---|---|
| A | NEUTRAL |
| B | TUNING (AM / FM) |
| C | VOLUME CONTROL |
| D | TUNING |
| E | TUNING 1 |
| F | TUNING 2 |
| G | TUNING 3 |
| H | TUNING 4 |
| I | TUNING 5 |

VEHICLE MOUNTED INPUT UNIT

BACKGROUND OF THE INVENTION

1. Field of the Invention

The present invention relates to a vehicle mounted input unit for centrally operating various types of electronic equipment, mounted on a motor vehicle, at a single manual operation section, and more particularly to a means to enhance versatility and multi-functional performance of the input unit.

2. Description of the Related Art

In the recent years, a motor vehicle is equipped with many electronic equipment such as an airconditioner, a radio, a television, a CD player and a navigation system. Since the individual operation of many electronic equipment may interfere with the driving of a motor vehicle, in order to facilitate the ON-OFF operations of desired electronic equipment, function selection, control of the selected function and others while ensuring safety operation, there has hitherto been proposed a vehicle mounted input unit capable of accomplishing all these operations by manipulating a single manual operation section.

FIGS. 8 to 13 are illustrations of a vehicle mounted input unit which has been proposed so far. FIG. 8 shows an interior of a motor vehicle incorporating a vehicle mounted input unit, FIG. 9 is a side elevational view showing a conventional vehicle mounted input unit, FIG. 10 is a plan view showing a manual operation section constituting the vehicle mounted input unit, FIG. 11 is a plan view showing a guide plate constituting the vehicle mounted input unit, FIG. 12 is a table showing the relationship between an engaging position of an engaging pin with a guide groove and a selected function when an airconditioner is selected through a switch device, and FIG. 13 is a table showing the relationship between an engaging position of an engaging pin with a guide groove and a selected function when a radio is selected through the switch device.

As FIG. 8 shows, this vehicle mounted input unit 100 is placed on a console box 200 existing between the driver's seat and the assistant's seat in the motor vehicle.

As FIGS. 9 to 11 show, this vehicle mounted input unit 100 is principally composed of a manual operation section 110 comprising two click switches 111, 112 and three rotary variable resistors 113, 114, 115, serving as a signal input means, an X-Y table 120 drivable in X directions and in Y directions perpendicular to the X directions through the manual operation section 110, a stick controller 130 serving as a position signal input means for inputting a signal corresponding to an operating direction and operating quantity of the X-Y table 120, and a guide plate 140 engaged through the X-Y table 120 with the manual operation section 110.

The manual operation section 110 and the X-Y table 120 are integrally connected through a connecting shaft 150 to each other, while the X-Y table 120 and the guide plate 140 are engaged with each other in a manner that a tip portion of an engaging pin 160 made to protrude from a lower surface of the X-Y table 120 is movably inserted into a guide groove 141 made in an upper surface of the guide plate 140. The guide groove 141 is, as shown in FIG. 11, made up of three vertical grooves 141*a*, 141*b*, 141*c* arranged at a constant interval, and one horizontal groove 141*d* connecting the central portions of these three vertical grooves 141*a*, 141*b*, 141*c*, with each of the grooves 141*a* to 141*d* being formed to have a width whereby the engaging pin 160 is movable only in its longitudinal directions. Accordingly, the manual operation section 110 and the X-Y table 120 are movable only in the X directions (the longitudinal directions of the horizontal groove 141*d*) and the Y directions (the longitudinal directions of the vertical grooves 141*a* to 141*c*) normal to the X directions within a range depending on the pattern and size of the guide groove 141.

The functional selection of the vehicle mounted electronic equipment is achievable in a manner that the engaging pin 160 is shifted to one of the positions of the end portions and intermediate portions of the respective vertical grooves 141*a*, 141*b*, 141*c* as indicated by reference marks A to I, and one of the two click switches 111, 112 on the manual operation section 110 is operated. That is, in this way, the positional information on the engaging position between the engaging pin 160 and the guide groove 141, selected through the operations of the manual operation section 110 and the X-Y table 120, can be outputted from the stick controller 130, which enables the selection of the function of the vehicle mounted electronic equipment, to be used, by that positional information.

In addition, the function of the electronic equipment selected through the operations of the manual operation section 110 and the clock switch 111 or 112 is adjustable by operating any one of the three rotary variable resistors 113, 114, 115 placed on the manual operation section 110.

The vehicle mounted input unit 100 thus constructed operates each electronic equipment convergently with a combination of a switch device (assembly) for selecting a desired one from a plurality of electronic equipment mounted on a motor vehicle, to be put to use, in an alternative way, a display unit for displaying the name of the electronic equipment selected by the switch device and the contents of operation by the vehicle mounted input unit 100 and a computer for controlling each of these equipment.

That is, as shown in FIG. 8, a switch device 170 comprising a combination of a plurality of (five in the example shown in FIG. 8) switches 171*a* to 171*e* is installed in the vicinity of a setting section of the vehicle mounted input unit 100 on the console box 200, and a display unit 180 such as a liquid crystal display is placed at a portion of the console box 180, which is easy to see from the driver's seat. Incidentally, the computer is to be placed within the console box 200 and is omitted from the illustration.

The switches 171*a* to 171*e* of the switch device 170 are individually connected to a plurality of electronic equipment mounted on a motor vehicle. For instance, let it be assumed that the switches 171*a*, 171*b*, 171*c*, 171*d* and 171*e* are individually connected to the airconditioner, the radio, the television, the CD player and the navigation system, respectively, the airconditioner can be selected in an alternative way by operating the switch 171*a*, while the radio can be selected in an alternative way by the operation of the switch 171*b*. Similar operations are done in terms of the other electronic equipment. Thus, the operation of one of the switches 171*a* to 171*e* provided in the switch device 170 allows the turning-on or turning-off of a desired electronic equipment.

The function selection and function control of the electronic equipment selected through the switch device 170 can be accomplished by the operation of the vehicle mounted input unit 100. The functions to be selectable through the vehicle mounted input unit 100 depend upon the type of electronic. equipment selected. For instance, if the airconditioner is selected through the switch device 170, the relationship between the engaging positions A to I of the engaging pin 160 with the guide groove 141 shown in FIG. 11 and the functions to be selected is as shown in FIG. 12. On the other hand, if the radio is selected through the switch device 170, the relationship between the engaging positions A to I and the functions to be selected is as shown in FIG. 13.

Meanwhile, the functions to be adjustable by the vehicle mounted input unit 100 also depend upon the type and function of the electronic equipment selected. For instance, if the airconditioner is selected through the switch device 170 and the "Air Quantity Control" is selected through the manual operation section 110, the air quantity is adjustable through the operation of the first rotary variable resistor 113. Further, if the airconditioner is selected through the switch device 170 and the "Temperature Control" is selected through the manual operation section 110, the setting of temperature for the airconditioner is adjustable through the manipulation of the second rotary variable resistor 114. On the other hand, if the radio is selected through the switch device 170 and the "Volume Control" is selected through the manual operation section 110, the volume of the radio is adjustable through the operation of the first rotary variable resistor 113. Further, if the radio is selected through the switch device 170 and the "Tuning" is selected through the manual operation section 110, the tuning of the radio can be done through the manipulation of the second rotary variable resistor 114.

In the vehicle mounted input unit 100 in the conventional example, the engaging pin 160 and the guide groove 141 are in engaging condition at all times, which is convenient in switching the functions of the electronic equipment mounted on a motor vehicle. However, since it is impossible to freely manipulate the manual operation section 110 regardless of the guide groove 141, there is an disadvantage in that difficulty is encountered to use this manual operation section 110 as an input unit represented by a common mouse type input unit (which will be referred to as a mouse in this specification) and difficulty is experienced to promote the versatility and functional performance of the equipment.

For instance, at themanipulation of the navigation system, there is a need for a cursor to be freely movable on a display, whereas the vehicle mounted input unit 100 in the conventional example does not permit the use of the manual operation section 110 as a mouse and, hence, requires separately a mouse or a stick controller for manipulating the navigation system. This inconvenience is not limited to the manipulation of the navigation system but applying to the operation of a personal computer or a computer game carried in a motor vehicle.

SUMMARY OF THE INVENTION

Accordingly, the present invention has been developed with a view to eliminating the drawback inherent in the conventional technique, and it is an object of this invention to provide a vehicle mounted input unit more excellent in versatility and functional performance.

For solve the above-mentioned problems, in accordance with this invention, there is provided a vehicle mounted input unit comprising a manual operation section including one or a plurality of signal inputting means, position signal inputting means for inputting a signal corresponding to a position of the manual operation section and guide means such as a guide plate for limiting an operational range of the manual operation section, wherein the engagement and disengagement between the manual operation section and the guide means is properly performed by operating guide plate drive means.

Thus, in the case that the manual operation section 70 and the guide means are engaged with each other, that is, when, as shown in FIG. 1, a guide section drive means such as a solenoid 50 is operated to raise a guide plate 40 so that an engaging pin 30 is put in a guide groove 41 made in the guide plate 40, like the conventional technique described above, the operation of the manual operation section 70 enables the switching of the function of electronic equipment mounted in a motor vehicle and the adjustment of the function to which the switching is made.

On the other hand, when the guide section drive means such as the solenoid 50 is operated to lower the guide plate 40 for releasing the manual operation section 70 and the guide plate 40 from their engagement, the manual operation section 70 is movable in an arbitrary direction and to an arbitrary position. Thus, the manual operation section 70 can be used as a mouse for moving a cursor appearing on a display, in using, for example, a navigation system, a personal computer or a computer game, which contributes to the improvement of versatility and multifunctional performance of the vehicle mounted input unit.

Besides, in order to enable the sensation of blind-touching when the function selected through the manipulation of the manual operation section 70 is a desired function, it is also appropriate that a vibration or excitation means is provided in the manual operation section 70 to provide to the driver vibrations different in mode for the respective functions selected.

In addition, in order to make the engaging pin 31 engage with the guide groove 41 smoothly and surely when the manual operation section 70 and the guide plate 40 are switched from the disengaging condition to the engaging condition, it is particularly preferable that a center return mechanism is provided in the manual operation section 70 to automatically return the manual operation section 70 to a predetermined center position when the manual operation section 70 is released from an external force applied thereto.

BRIEF DESCRIPTION OF THE DRAWINGS

The object and features of the present invention will become more readily apparent from the following detailed description of the preferred embodiment taken in conjunction with the accompanying drawings in which:

FIG. 12 is a table showing the correspondence between engaging positions of an engaging pin with a guide groove and functions to be selected when an airconditioner is selected through a switch device; and FIG. 13 is a table showing the correspondence between engaging positions of an engaging pin with a guide groove and functions to be selected when a radio is selected through a switch device.

DETAILED DESCRIPTION OF THE INVENTION

Figure 1:
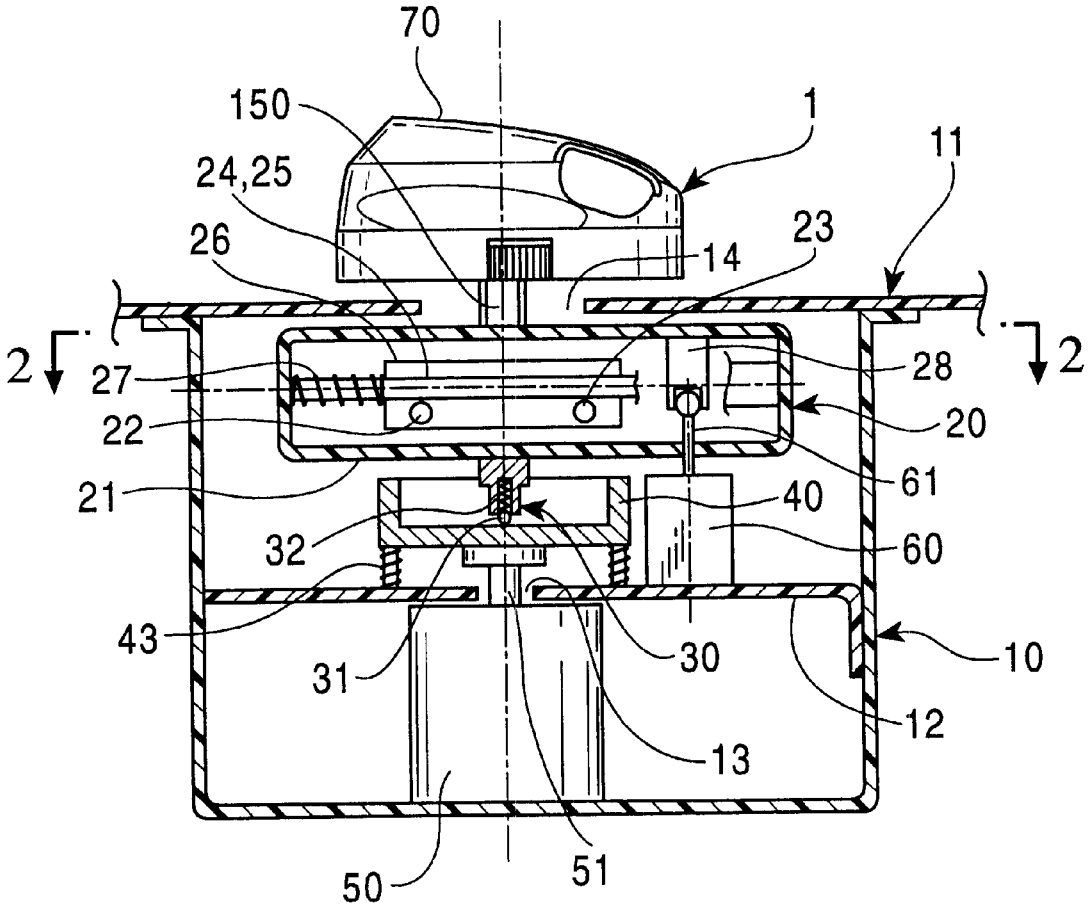
FIG. 1 is a cross-sectional view showing the essence of a vehicle mounted input unit according to an embodiment of this invention.
Figure 2:
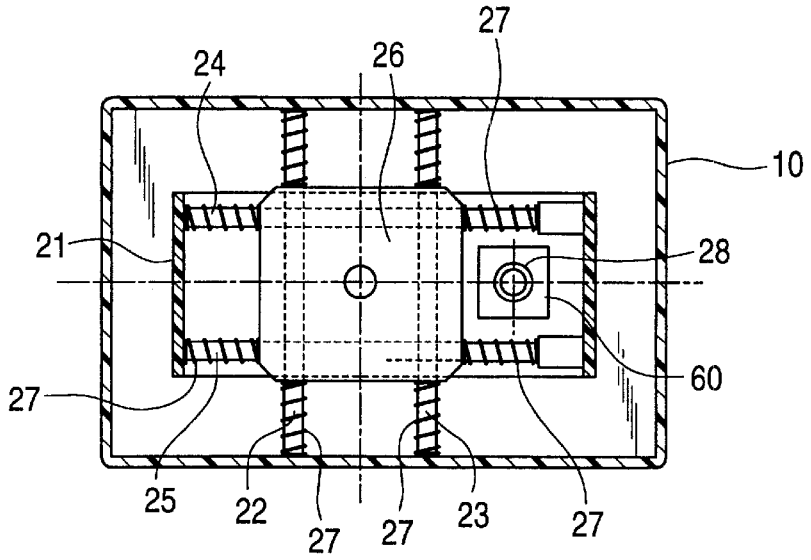
FIG. 2 is a cross-sectional view taken along a line 2—2 of FIG. 1.
Figure 3:
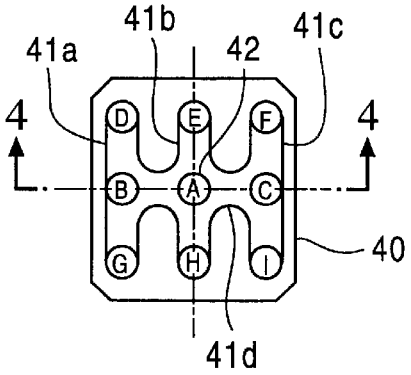
FIG. 3 is a plan view showing a guide plate in this embodiment.
Figure 4:
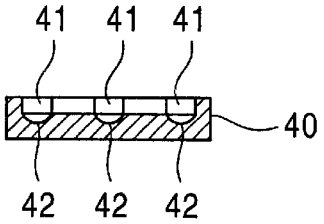
FIG. 4 is a cross-sectional view taken along a line 4—4 of FIG. 3.
Figure 5:
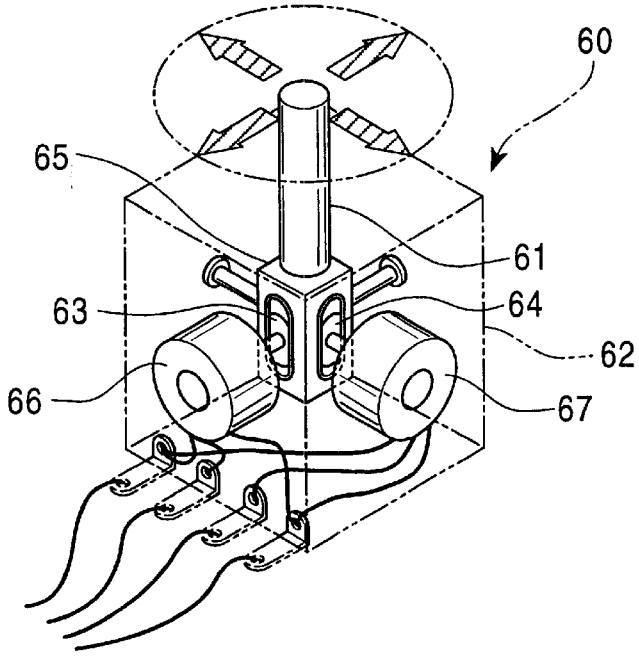
FIG. 5 is an illustration of a structure of a stick controller.
Figure 6:
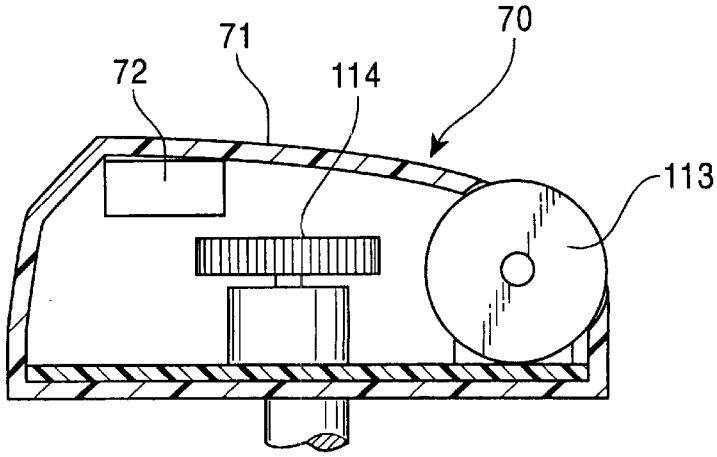
FIG. 6 is a cross-sectional view showing the essence of a manual operation section.
Figure 7:
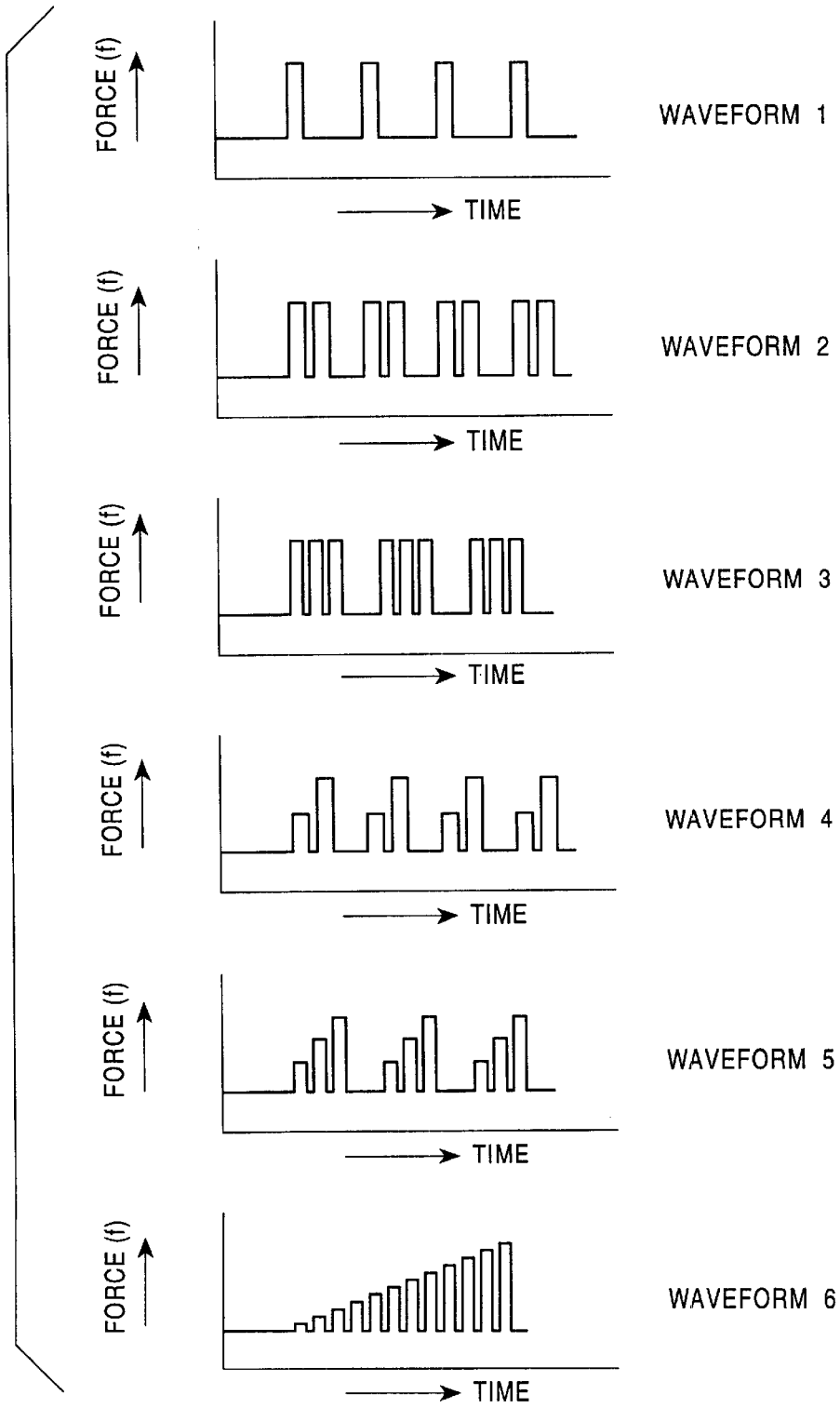
FIG. 7 is an illustration of waveforms showing examples of modes of vibrations to be applied to the manual operation section.

Referring to FIGS. 1 to 7, a description will be made hereinbelow of one example of vehicle mounted input unit according to en embodiment of the present invention. FIG. 1 is a cross-sectional view showing the essence of a vehicle mounted input unit according to this embodiment, FIG. 2 is a cross-sectional view taken along a line 2—2 of FIG. 1, FIG. 3 is a plan view showing a guide plate in this embodiment, FIG. 4 is a cross-sectional view taken along a line 4—4 of FIG. 3, FIG. 5 is an illustration of a structure of a stick controller, FIG. 6 is a cross-sectional view showing the essence of a manual operation section, and FIG. 7 is an illustration of waveforms showing examples of modes of vibrations to be applied to the manual operation section.

In FIG. 1, reference numeral 1 represents a vehiclemounted input unit according to this embodiment, designed to be mounted in a motor vehicle, numeral 10 designates a body of equipment (housing) for accommodating components of the vehicle mounted input unit 1, numeral 11 denotes a panel installed on an opening side of the body of equipment 10, numeral 20 depicts an X-Y table, numeral 30 shows an engaging pin, numeral 40 indicates a guide plate serving as a guide means, numeral 50 signifies a solenoid acting as a guide plate drive means, numeral 60 represents a stick controller functioning as a position signal inputting means, and numeral 70 designates a manual operation section, wherein the members or components equivalent to those shown in the above-described illustrations are marked with the same reference numerals.

As seen from FIG. 1 or 2, the body of equipment 10 is formed into a rectangular configuration capable of accommodating the X-Y table 20, the engaging pin 30, the guide plate 40, the solenoid 50 and the stick controller 60, and further includes internally a partition plate 12 for holding the guide plate 40 and the stick controller 60. In this partition plate 12, a through hole 13 is made to accept the penetration of a drive shaft 51 of the solenoid 50. Additionally, in the panel 11 installed on the opening side of the body of equipment 10, there is a through hole 14 made to accept the penetration of a connecting shaft 150 for making a connection between the manual operation section 70 and the X-Y table 20.

The X-Y table 20 is, as seen from FIGS. 1 and 2, composed of a loop-like slider 21 connected through the connecting shaft 150 to the manual operation section 70, two X-direction guide rods 22, 23, two Y-direction guide rods 24, 25, a slider block 26 placed in the interior of the slider 21 for holding the slider 21 through the guide rods 22 to 25 so that the slider 21 is movable in the X directions and the Y directions, a spring(s) 27 serving as a center return mechanism to bias the slider 21 in a direction that the center of the slider 21 always coincides with the center of the slider block 26, and a connecting section 28 for manipulating an operating lever 61 of the stick controller 60.

In a first side surface portion of the slider block 26 two through holes are made at a predetermined interval and in parallel with each other to accept the penetration of the X-direction guide rods 22, 23, while in a second side surface portion perpendicular to the first side surface portion two through holes are made at a predetermined interval and in parallel with each other to accept the penetration of the Y-direction guide rods 24, 25. The two X-direction guide rods 22, 23 are penetrated into the through holes, made in the first side surface portion of the slider block 26, to be slidable, with their both end portions being held on two surfaces of the body of equipment 10, being in opposed relation to each other, as shown in FIG. 2. On the other hand, the two Y-direction guide rods 24, 25 are inserted into the through holes, made in the second side surface portion of the slider block 26, to be slidable, with their both end portions being held on two surfaces of the slider 21, being in opposed relation to each other, as shown in FIGS. 1 and 2. Accordingly, the slider 21 is freely movable in both the X directions (directions along the X-direction guide rods 22, 23) and Y directions (directions along the Y-direction guide rods 24, 25) with respect to the slider block 26.

The engaging pin 30 is fitted to a central portion of a lower surface of the slider 21 to be directed downwardly. A tip portion of this engaging pin 30 accommodates a small-diameter ball 31 to permit it to be movable, while the small-diameter ball 31 is always biased downwardly by a spring 32. The small-diameter ball 31 is set so that its portion protrudes downwardly from the tip portion of the engaging pin 30, and is brought into elastic contact with a bottom surface of a guide groove (groove assembly) 41 made in the guide plate 40.

On an upper surface of the guide plate 40 there are made the guide groove 41 comprising three vertical grooves 41*a*, 41*b*, 41*c* and one horizontal groove 41*d* making connections between the central portions of the three vertical grooves 41*a*, 41*b*, 41*c*, with shallow semi-spherical hollows 42 being formed in the bottom surfaces of the end portions and central portions of the respective grooves 41*a* to 41*d*. As shown in FIG. 1, this guide plate 40 is fitted onto an upper surface of the partition plate 12 to be movable up and down, and further is connected to the drive shaft 51 of the solenoid 50. Additionally, between the guide plate 40 and the upper surface of the partition plate 12, there is interposed a spring 43 for biasing the guide plate 40 at all times. Accordingly, this guide plate 40 always moves upwardly by the elastic force of the spring 43 at the de-energization to the solenoid 50, while moves downwardly by the attraction of the solenoid 50 at the energization to the solenoid 50.

Besides, the height position of the guide plate 40 at the de-energization of the solenoid 50 is set so that the engaging pin 30 engages with the guide groove 41 and the small-diameter ball 31 placed at the tip portion of the engaging pin 30 comes elastically into contact with the bottom surface of the guide groove 41 owing to the elastic force of the spring 32. On the other hand, the height position of the guide plate 40 at the energization of the solenoid 50 is set so that the guide groove 41 and the engaging pin 30 can be released from their engagement.

The stick controller 60 is set on the partition plate 12, and its operating lever 61 is connected to a connecting section 28, provided on the slider 21 of the X-Y table 20, so that it can swing or rock. Although a well-known and arbitrary one can be used as the stick controller 60, because of a simple structure and a high position detection accuracy, it is particularly preferable to use a stick controller shown in FIG. 5, which comprises an operating lever 61 placed on a body of equipment 62 so that it can take a swing motion, a converting section 65 for converting an inclination angle and direction of the operating lever 61 into rotating quantities of two rotors 63, 64 disposed at right angles to each other, and two rotary variable resistors or encoders 66, 67 for converting the rotating quantities of the two rotors 63, 64 into electric signals.

Figure 8:
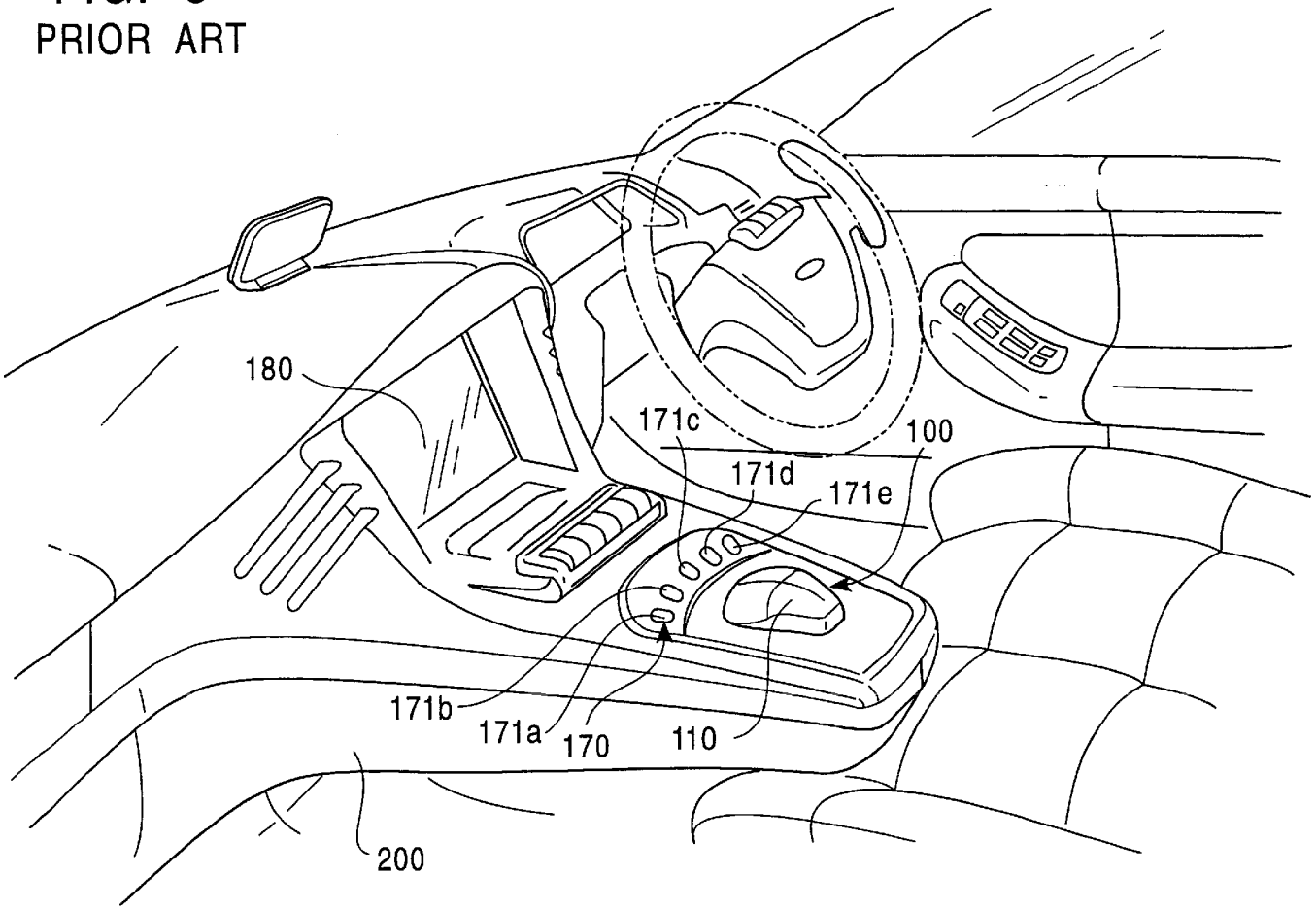
FIG. 8 PRIOR ART
FIG. 8 is an illustration of the interior of a motor vehicle equipped with a vehicle mounted input unit.
Figure 9:
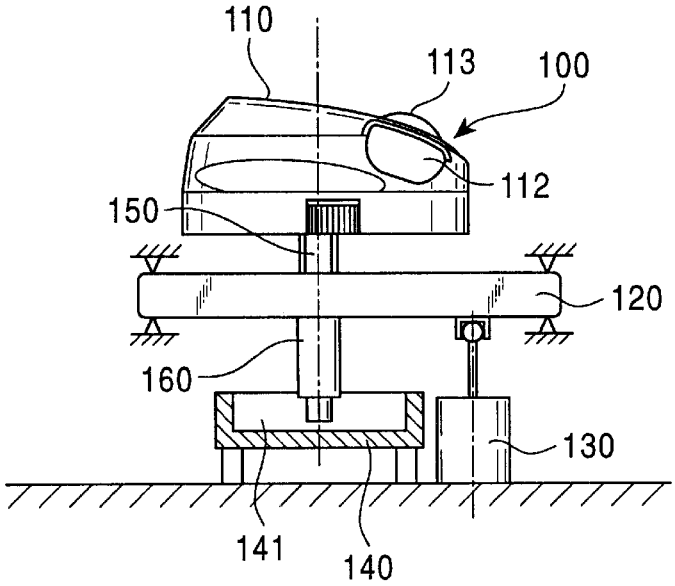
FIG. 9 PRIOR ART
FIG. 9 is a side elevational view showing a conventional vehicle mounted input unit.
Figure 10:
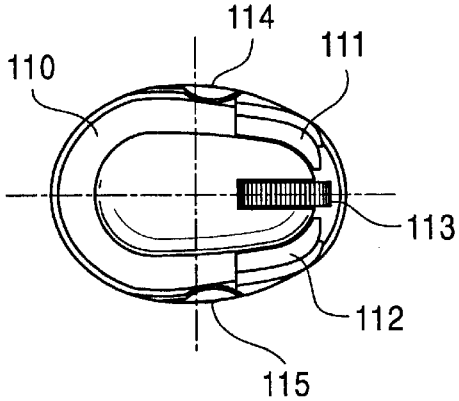
FIG. 10 PRIOR ART
FIG. 10 is a plan view showing a conventional manual operation section.
Figure 11:
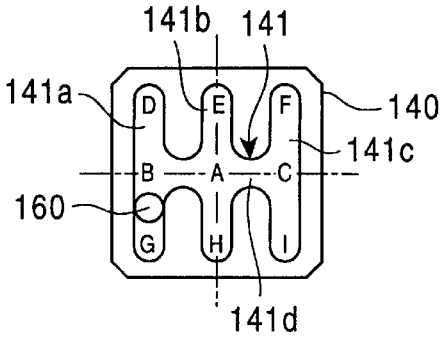
FIG. 11 PRIOR ART
FIG. 11 is a plan view showing a conventional guide plate.

Like the above-described manual operation section 110, the manual operation section 70 to be used is made up of two click switches 112, 113 and three rotary variable resistors 113, 114, 115. As shown in FIG. 6, a vibration device 72 is provided on an inner surface of a casing 71 constituting the manual operation section 70 to, when the small-diameter ball 31 of the engaging pin 30 is engaged with any one of the hollows 42, whose number is 9 in total, made in the guide groove 41 and any one of the two click switches 111, 112 of the manual operation section 70 is manipulated, generate a peculiar vibration corresponding to the position of that hollow 42, thereby recognizing whether or not the switching position of the guide groove 41 selected by the driver is the desired switching position in a blind touch way. FIG. 7 illustrates vibration modes at the respective switching positions. The switching of the vibration modes is made by a computer, installed in the interior of a console box 200 (see FIG. 8), in accordance with positional signals outputted from the stick controller 60.

Although the vibration device 72 is particularly preferable to have a solenoid or a piezo element as a drive source because of its simple structure, additionally it is also possible to use the so-called vibrator in which a weight is attached eccentrically to a motor shaft or a device in which a weight is attached to a tip portion of an elastic member made of a ferromagnetic material and the elastic member is excited by an electromagnet. Incidentally, in the case shown in FIG. 6, although the vibration device 72 is fitted directly to the casing of the manual operation section 70, in order to transmit a large vibration to the driver with a small vibration device, it is also possible that a vibration plate is placed in the interior of the casing and the vibration device 72 is fitted onto the vibration plate.

As well as the conventional vehicle mounted input unit 100, the vehicle mounted input unit 1 according to this embodiment involves a combination of a switch device 170 for selecting desired electronic equipment to be operated from a plurality of electronic equipment mounted in the motor vehicle in an alternative manner, a display device 180 for displaying the name of the electronic equipment selected by the switch device 170 and the contents of the operation by the vehicle mounted input unit 1 and a computer (not shown) provided in the console box 200 for controlling these devices, thus exhibiting desired functions.

Secondly, a description will be given hereinbelow of an operation of the vehicle mounted input unit 1 thus constructed according to this embodiment.

In the vehicle mounted input unit 1 according to this embodiment, the guide groove 41 and the engaging pin 30 can be switched to the engaging condition or the engagement-released condition by switching between the ON and OFF of the energization to the solenoid 50. That is, when the solenoid 50 is in the de-energization condition, the guide plate 40 is lifted by the elastic force of the spring 43 so that the engaging pin 30 engages with the guide groove 41. In this case, the selection of the function of each of the electronic equipment mounted on the motor vehicle and the adjustment of the function selected can be done in the same way as that of the conventional vehicle mounted input unit 100. Incidentally, in the vehicle mounted input unit 1 according to this embodiment, the hollows 42, whose number is 9 in total, are made in the end portions and central portions of the grooves 41*a* to 41*d* constituting the guide groove 41 and the small-diameter ball 31 is provided on the tip portion of the engaging pin 30 so that the entrance and exit are possible, and, therefore, when the manual operation section 70 is manipulated to switch the contact position of the engaging pin 30 with the guide groove 41, a click sensation is given to the driver whenever the hollows 42 and the ball 31 are engaged with each other. Accordingly, the function switching of the electronic equipment is achievable more easily and surely by blind touch, thereby reducing the possible troubles in function switching caused by the operational errors.

Furthermore, in the vehicle mounted input unit 1 according to this embodiment, the manual operation section 70 is equipped with the vibration device 72 to generate a mode-different vibration at each of the switching positions in the manual operation section 70, and, therefore, the confirmation as to whether or not the manual operation section 70 is manipulated to the desired switching position can be made by blind touch, that is, in a manner that the driver senses the vibration. Accordingly, it is possible to reduce the switching errors of the manual operation section 70, which results in the reduction of operational errors on the electronic equipment.

On the other hand, when the solenoid is switched into the energized condition, its drive shaft 51 is attracted downwardly so that the guide plate 40 is lowered against the elastic force of the spring 43. Thus, the guide groove 41 and the engaging pin 30 are released from their engagement, with the result that the manual operation section 70 becomes freely movable within the operating range of the X-Y table 20 without being restricted by the guide groove 41. Accordingly, for example, in using a navigation system, a personal computer or a computer game, the movement of the cursor appearing on the display becomes possible through the manual operation section 70.

After the use of the personal computer or the like, if the manual operation section 70 of the vehicle mounted input unit is again used for the function switching of each of the electronic equipment mounted on the motor vehicle, the driver or the like lets go his hold of the manual operation section 70 to cut off the energization to the solenoid. Since the X-Y table 20 is equipped with the spring 27 serving as a center return mechanism, when releasing his hand from the manual operation section 70, the X-Y table 20 automatically returns to the center position, and the engaging pin 30 attached to the X-Y table 20 moves to the central portion of the guide groove 41, that is, a portion confronting the switching position E. Accordingly, even though the guide plate 40 is lifted by the elastic force of the spring 43 after the de-energization to the solenoid 50, the engaging pin 30 and the guide plate 40 do not collide with each other and the use mode of the manual operation section 70 can easily switched.

Besides, the point of this invention is that the engagement and disengagement between the manual operation section 70 and the guide means (guide plate 40) are selectively made by manipulating the guide plate drive means such as a solenoid. The other components can properly be omitted or added as needed.

For instance, in the above-described embodiment, although the hollows, whose number is 9 in total, are made at the end portions and central portions of the grooves 41*a* to 41*d* constituting the guide groove 41 and the small-diameter ball 31 is provided in the tip portion of the engaging pin 30 to get in and out so that a click sensation is given to the driver at the operation of the manual operation section 70, this structure is omissible.

In addition, in the above-described embodiment, although the manual operation section 70 is equipped with the vibration device 72 to generate a different-mode vibration at each of the switching positions of the manual operation section 70, this structure is also omissible.

Still additionally, in the above-described embodiment, although the manual operation section 70 and the stick controller 60 are coupled indirectly to each other in a state where the X-Y table 20 is interposed therebetween, naturally it is also possible that both the members 70 and 60 are directly coupled to each other. Further, in place of the X-Y table 20, another moving member can also be interposed between the manual operation section 70 and the stick controller 60.

Moreover, in the above-described embodiment, although the solenoid 50 is employed as the guide plate drive means, this invention is not limited to this, but it is also appropriate to use a combination of a motor and a power transmission mechanism for converting the rotating force of the motor into an upward and downward moving force.

As described above, according to a first aspect of this invention, since a guide means is movable up and down through the use of a guide plate drive means such as a solenoid and a guide groove and an engaging pin are properly released from their engagement, inusing, for example, a navigation system, apersonal computer or a computer game, it is possible to use a manual operation section as a mouse for shifting a cursor appearing on a display, which contributes to the improvement of versatility and multi-functional performance of the unit.

Furthermore, according to a second aspect of this invention, since the manual operation section is provided with a vibration means to generate a different-mode vibration at each of the switching positions of the manual operation section, the driver can sense, through blind touch, whether or not the manual operation section is manipulated to a desired switching position, which contributes to the reduction of switching errors of the manual operation section without hindering the safety driving of a motor vehicle.

Still further, according to a third aspect of this invention, since the manual operation section is automatically returned to a center position so that the engaging pin connected to the manual operation section moves up to a central portion of the guide groove when the driver releases his hand from the manual operation section, in the case that the use of a personal computer or the like comes to an end and the manual operation section of the vehicle mounted input unit is again used for the function switching of each of electronic equipment mounted on the motor vehicle, it is a simply a matter of operating the guide plate drive means to lift the guide means, with the result that the multi-functional performance of the vehicle mounted input unit can improve without hindering the convenience in use.

It should be understood that the foregoing relates to only preferred embodiment of the present invention, and that it is intended to cover all changes and modifications of the embodiment of the invention herein used for the purpose of the disclosure, which do not constitute departures from the spirit and scope of the invention.

What is claimed is:

1. A vehicle mounted input unit comprising:

a body of equipment;

an X-Y table disposed in said body of equipment;

a manual operation section disposed external to said body of equipment and connected to said X-Y table so as to slide in a two-dimensional manner;

an engaging pin connected with said manual operation section;

a guide having a guide groove, the guide movable with respect to said engaging pin so as to engage with and disengage from said engaging pin, said guide allowing said manual operation section to function as a mouse capable of arbitrarily moving in a two-dimensional manner when disengaged with said engaging pin and allowing said manual operation section to move in a range limited by said guide groove when engaged with said engaging pin;

a guide driver to perform switching between engagement and disengagement of said guide with and from said engaging pin by moving said guide; and a position signal input mechanism connected with said manual operation section so as to input signals corresponding to all positions in a moving area of said manual operation section when said engaging pin and said guide are disengaged.

2. A vehicle mounted input unit as defined in claim 1, wherein said guide driver is a solenoid attached onto said body of the equipment and said guide is moved downward by attraction of said solenoid so as to be disengaged from said engaging pin.

3. The vehicle mounted input unit of claim 1, wherein said guide is constantly urged upward by a spring.

4. The vehicle mounted input unit of claim 1, wherein said X-Y table is disposed between said manual operation section and said engaging pin, and includes a slider and a slider block disposed in said slider so as to support said slider movably relative to said body of equipment in an axial direction and a direction orthogonal to said axial direction.

5. The vehicle mounted input unit of claim 4, further comprising:

a first guide rod passing through said slider block and attached to an inner wall of said body of equipment so as to support said slider block for movement with respect to said body in said axial direction; and a second guide rod intersecting said first guide rod and passing through said slider block in said slider so as to support said slider block movably in the direction orthogonal to said axial direction.

6. The vehicle mounted input unit of claim 1, wherein said guide groove formed in said guide is H-shaped.

7. The vehicle mounted input unit of claim 1, wherein said manual operation section has at least one signal input mechanism.

8. The vehicle mounted input unit of claim 7, wherein said signal input mechanism is one of a click switch and a rotary variable resistor.

9. The vehicle mounted input unit of claim 1, wherein said position signal input mechanism is a stick controller.

10. The vehicle mounted input unit of claim 9, wherein said stick controller is swingably attached with a connecting section formed on said X-Y table.

11. The vehicle mounted input unit of claim 9, wherein said stick controller includes an operating lever, a converting section to convert an inclination angle and direction of said operating lever into rotating quantities of two rotors disposed at right angles to each other, and an electric-signal converting section to convert the rotating quantities into electric signals.

12. The vehicle mounted input unit of claim 1, wherein a semi-spherical hollow is formed in an end portion and a central portion of said guide groove.

13. The vehicle mounted input unit of claim 7, wherein said manual operation section has a vibration device, and said vibration device generates vibration in a vibration mode corresponding to the position of said manual operation section when an input signal is input from said signal input mechanism.

14. The vehicle mounted input unit of claim 13, wherein vibration mode is switched in response to an input signal from said position signal input mechanism.

15. The vehicle mounted input unit of claim 1, wherein said manual operation section has a vibration device, and said vibration device is directly fitted to a casing of said manual operation section.

16. A vehicle mounted input unit as defined in claim 1, further comprising a center return mechanism to automatically return said manual operation section to a predetermined center position when an external force applied to said manual operation section is removed therefrom.

17. A vehicle mounted input unit comprising:

a body of equipment;

an X-Y table disposed in said body of equipment;

a manual operation section disposed external to said body of equipment and connected to said X-Y table so as to slide in a two-dimensional manner;

an engaging pin connected with said manual operation section;

a guide having a guide groove, the guide movable with respect to said engaging pin so as to engage with and disengage from said engaging pin, said guide allowing said manual operation section to function as a mouse capable of arbitrarily moving in a two-dimensional manner when disengaged with said engaging pin and allowing said manual operation section to move in a range limited by said guide groove when engaged with said engaging pin;

a guide driver to perform switching between engagement and disengagement of said guide with and from said engaging pin by moving said guide;

a position signal input mechanism connected with said manual operation section so as to input signals corresponding to all positions in a moving area of said manual operation section when said engaging pin and said guide are disengaged;

at least one signal input mechanism disposed in said manual operation section; and a vibration device disposed in said manual operation section.

18. The vehicle mounted input unit of claim 17, wherein said guide driver is a solenoid attached onto said body of the equipment and said guide is moved downward by attraction of said solenoid so as to be disengaged from said engaging pin.

19. A vehicle mounted input unit as defined in claim 17, further comprising a center return mechanism to automatically return said manual operation section to a predetermined center position when an external force applied to said manual operation section is removed therefrom.

20. A vehicle mounted input unit as defined in claim 17, wherein said guide comprises a guide plate elastically biased with respect to the engaging pin and said guide groove is an H-shaped groove.

21. A vehicle mounted input unit as defined in claim 17, wherein said guide section driver comprises a solenoid attached to said body, said solenoid when energized producing an attracting force acting to downwardly move said guide thereby disengaging said engaging pin from said guide groove.

22. The vehicle mounted input unit of claim 17, wherein said guide is constantly urged upward by a spring.

23. The vehicle mounted input unit of claim 17, wherein said X-Y table is disposed between said manual operation section and said engaging pin, and includes a slider and a slider block disposed in said slider so as to support said slider movably relative to said body of equipment in an axial direction and a direction orthogonal to said axial direction.

24. The vehicle mounted input unit of claim 17, further comprising:

a first guide rod passing through said slider block and attached to an inner wall of said body of equipment so as to support said slider block for movement with respect to said body in said axial direction; and a second guide rod intersecting said first guide rod and passing through said slider block in said slider so as to support said slider block movably in the direction orthogonal to said axial direction.

25. The vehicle mounted input unit of claim 17, wherein said guide groove formed in said guide is H-shaped.

26. The vehicle mounted input unit of claim 17, wherein said signal input mechanism is one of a click switch and a rotary variable resistor.

27. The vehicle mounted input unit of claim 17, wherein said position signal input mechanism is a stick controller.

28. The vehicle mounted input unit of claim 27, wherein said stick controller is swingably attached with a connecting section formed on said X-Y table.

29. The vehicle mounted input unit of claim 27, wherein said stick controller includes an operating lever, a converting section to convert an inclination angle and direction of said operating lever into rotating quantities of two rotors disposed at right angles to each other, and an electric-signal converting section to convert the rotating quantities into electric signals.

30. The vehicle mounted input unit of claim 17, wherein a semi-spherical hollow is formed in an end portion and a central portion of said guide groove.

31. The vehicle mounted input unit of claim 17, wherein said vibration device generates vibration in a vibration mode corresponding to the position of said manual operation section when an input signal is input from said signal input mechanism.

32. The vehicle mounted input unit of claim 31, wherein vibration mode is switched in response to an input signal from said position signal input mechanism.

33. The vehicle mounted input unit of claim 17, wherein said vibration device is directly fitted to a casing of said manual operation section.

* * * * *